US008373628B2

(12) United States Patent
Fish

(10) Patent No.: US 8,373,628 B2
(45) Date of Patent: Feb. 12, 2013

(54) ACTIVE MATRIX DISPLAY DEVICES

(75) Inventor: David A. Fish, Haywards Heath (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 1204 days.

(21) Appl. No.: 11/569,713

(22) PCT Filed: Jun. 2, 2005

(86) PCT No.: PCT/IB2005/051796

§ 371 (c)(1),
(2), (4) Date: Nov. 28, 2006

(87) PCT Pub. No.: WO2005/122121

PCT Pub. Date: Dec. 22, 2005

(65) Prior Publication Data

US 2007/0236430 A1 Oct. 11, 2007

(30) Foreign Application Priority Data

Jun. 5, 2004 (GB) ..... 0412586.0

(51) Int. Cl.
*G09G 3/32* (2006.01)

(52) U.S. Cl. ..... 345/82; 345/76; 315/169.1

(58) Field of Classification Search ..... 345/76, 345/81, 82; 315/169.1
See application file for complete search history.

(56) References Cited

U.S. PATENT DOCUMENTS 6,320,325 B1 11/2001 Cok et al.
6,356,029 B1 * 3/2002 Hunter ..... 315/169.1
6,392,617 B1 5/2002 Gleason
6,441,560 B1 * 8/2002 Hunter ..... 315/169.1
2002/0171611 A1 11/2002 Cok
2006/0038758 A1 * 2/2006 Routley et al. ..... 345/81
2007/0182674 A1 * 8/2007 Fish et al. ..... 345/76

FOREIGN PATENT DOCUMENTS

EP 1096466 A1 5/2001
WO WO0120591 A1 3/2001
WO WO03038790 A2 5/2003
WO WO2004023444 A1 3/2004
WO WO 2004084168 A1 * 9/2004

* cited by examiner

*Primary Examiner* — Viet Pham

(57) ABSTRACT

An active matrix display device has an array of display pixels, each pixel comprising a current-driven light emitting display element (2), a drive transistor (22) for driving a current through the display element and pixel circuitry including an optical feedback element (38) for controlling the drive transistor to drive a substantially constant current through the display element for a duration which depends on the desired display pixel output level and an optical feedback signal of the optical feedback element. An output configuration is applied to the display which includes values for the pixel power supply voltages, the field period and an allowed range of pixel drive levels. The output configuration is varied in response to ageing of the display element. In this device, an output configuration is varied as the device ages, so that the optical feedback system can continue to provide compensation for differential ageing of the display elements for a longer period of use of the display.

16 Claims, 9 Drawing Sheets

ACTIVE MATRIX DISPLAY DEVICES

This invention relates to active matrix display devices, particularly but not exclusively active matrix electroluminescent display devices having thin film switching transistors associated with each pixel.

Matrix display devices employing electroluminescent, light-emitting, display elements are well known. The display elements may comprise organic thin film electroluminescent elements, for example using polymer materials, or else light emitting diodes (LEDs) using traditional III-V semiconductor compounds. Recent developments in organic electroluminescent materials, particularly polymer materials, have demonstrated their ability to be used practically for video display devices. These materials typically comprise one or more layers of a semiconducting conjugated polymer sandwiched between a pair of electrodes, one of which is transparent and the other of which is of a material suitable for injecting holes or electrons into the polymer layer.

FIG. 1 shows a known active matrix addressed electroluminescent display device. The display device comprises a panel having a row and column matrix array of regularly-spaced pixels, denoted by the blocks 1 and comprising electroluminescent display elements 2 together with associated switching means, located at the intersections between crossing sets of row (selection) and column (data) address conductors 4 and 6. Only a few pixels are shown in the Figure for simplicity. In practice there may be several hundred rows and columns of pixels. The pixels 1 are addressed via the sets of row and column address conductors by a peripheral drive circuit comprising a row, scanning, driver circuit 8 and a column, data, driver circuit 9 connected to the ends of the respective sets of conductors.

Display devices of this type have current-addressed display elements. There are a large number of pixel circuits for providing a controllable current through the display element, and these pixel circuits typically include a current source transistor, with the gate voltage supplied to the current source transistor determining the current through the display element. A storage capacitor holds the gate voltage after the addressing phase.

For circuits based on polysilicon, there are variations in the threshold voltage of the transistors due to the statistical distribution of the polysilicon grains in the channel of the transistors. Polysilicon transistors are, however, fairly stable under current and voltage stress, so that the threshold voltages remain substantially constant.

The variation in threshold voltage is small in amorphous silicon transistors, at least over short ranges over the substrate, but the threshold voltage is very sensitive to voltage stress. Application of the high voltages above threshold needed for the drive transistor causes large changes in threshold voltage, which changes are dependent on the information content of the displayed image. There will therefore be a large difference in the threshold voltage of an amorphous silicon transistor that is always on compared with one that is not. This differential ageing is a serious problem in LED displays driven with amorphous silicon transistors.

In addition to variations in transistor characteristics there is also differential ageing in the LED itself. This is due to a reduction in the efficiency of the light emitting material after current stressing. In most cases, the more current and charge passed through an LED, the lower the efficiency.

There have been proposals for voltage-addressed pixel circuits which compensate for the aging of the LED material. For example, various pixel circuits have been proposed in which the pixels include a light sensing element. This element is responsive to the light output of the display element and acts to leak stored charge on the storage capacitor in response to the light output, so as to control the integrated light output of the display during the address period. FIG. 2 shows one example of pixel layout for this purpose. Examples of this type of pixel configuration are described in detail in WO 01/20591 and EP 1 096 466.

The drive transistor 22 is controlled by the voltage on its gate, which is stored on a capacitor 24, during an addressing phase. During the addressing phase, the desired voltage is transferred from the column 6 to the capacitor 24 by means of an addressing transistor 16, which is turned on only during the addressing phase.

In the pixel circuit of FIG. 2, a photodiode 27 discharges the gate voltage stored on the capacitor 24. The EL display element 2 will no longer emit when the gate voltage on the drive transistor 22 reaches the threshold voltage, and the storage capacitor 24 will then stop discharging. The rate at which charge is leaked from the photodiode 27 is a function of the display element output, so that the photodiode 27 functions as a light-sensitive feedback device. It can be shown that the integrated light output, taking into the account the effect of the photodiode 27, is given by:

$$L_T = \frac{C_S}{\eta_{PD} \cdot T_F}(V(0) - V_T) \quad [1]$$

In this equation, $\eta_{PD}$ is the efficiency of the photodiode, which is very uniform across the display, $C_S$ is the storage capacitance, $T_F$ is the frame time, V(0) is the initial gate-source voltage of the drive transistor and $V_T$ is the threshold voltage of the drive transistor. The light output is therefore independent of the EL display element efficiency and thereby provides aging compensation. However, $V_T$ varies across the display so it will exhibit non-uniformity.

There are refinements to this basic circuit, but the problem remains that practical voltage-addressed circuits are still susceptible to threshold voltage variations. Thus, the circuit of FIG. 2 will not compensate for the stress induced threshold voltage variations of an amorphous silicon drive transistor. Furthermore, as the capacitor holding the gate-source voltage is discharged, the drive current for the display element drops gradually. Thus, the brightness tails off. This gives rise to a lower average light intensity.

The applicant has proposed an alternative optical feedback pixel circuit, in which the drive transistor is controlled to provide a constant light output from the display element. The optical feedback, for aging compensation, is used to alter the timing of operation (in particular the turning on) of a discharge transistor, which in turn operates to switch off the drive transistor rapidly. The timing of operation of the discharge transistor is also dependent on the data voltage to be applied to the pixel. In this way, the average light output can be higher than schemes which switch off the drive transistor more slowly in response to light output. The display element can thus operate more efficiently. Any drift in the threshold voltage of the drive transistor will manifest itself as a change in the (constant) brightness of the display element. As a result, the modified optical feedback circuit proposed by the applicant compensates for variations in output brightness resulting both from LED ageing and drive transistor threshold voltage variations.

While the known pixel circuits, and particularly the proposed pixel circuit outlined above (and explained further below), can provide correction for differential ageing of LED display elements of different pixels, they do not extend the lifetime of the display.

According to the invention, there is provided an active matrix display device comprising an array of display pixels, each pixel comprising:

a current-driven light emitting display element;

a drive transistor for driving a current through the display element;

pixel circuitry including an optical feedback element, for controlling the drive transistor to drive a substantially constant current through the display element for a duration which depends on the desired display pixel output level and an optical feedback signal of the optical feedback element; and control means for applying an output configuration for the display, the output configuration including values for at least the pixel power supply voltages, the field period and an allowed range of pixel drive levels, wherein the control means is adapted to vary the output configuration by varying one or more of said values in response to ageing of the display element.

In this device, an output configuration is varied as the device ages, so that the optical feedback system can continue to provide compensation for differential ageing of the display elements for a longer period of use of the display.

The pixel circuitry may comprise a storage capacitor for storing a voltage to be used for addressing for the drive transistor and a discharge transistor for discharging the storage capacitor thereby to switch off the drive transistor. A light-dependent device then controls the timing of the operation of the discharge transistor by varying the gate voltage applied to the discharge transistor in dependence on the light output of the display element. This duty cycle control scheme enables the display element to operate at substantially full brightness, and this in turn enables the field period to be reduced to a minimum, which is desirable for large displays.

A discharge capacitor may be provided between the gate of the discharge transistor and a constant voltage line, and the light dependent device is then for charging or discharging the discharge capacitor.

Each pixel may further comprise a charging transistor connected between a charging line and the gate of the drive transistor and each pixel may further comprise an isolating transistor connected in series with the drive transistor.

In one arrangement, power supply lines are provided for each column of pixels. For example, different power lines can be provided for columns of different colour pixels. These vertical power lines can also be used for monitoring purposes, to monitor the ageing of the display elements. For example, each pixel may further comprise a readout transistor to enable detection of the state of the drive transistor from a column conductor. By detecting the state of the drive transistor at the end of a field period, it can be determined whether or not the optical feedback system has turned off the drive transistor. If not, this is indicative of ageing of the display element to such an extent that the current operating characteristics of the display do not allow correct compensation to take place.

In one arrangement, each pixel further comprises a readout transistor to enable detection of the state of the drive transistor from a column conductor. Alternatively, each column of pixels further comprises a readout transistor to enable detection of the state of the drive transistors in the column.

The invention also provides a method of driving an active matrix display device comprising an array of display pixels each comprising a drive transistor, a current-driven light emitting display element and pixel circuitry including an optical feedback element, the method comprising:

(i) applying an output configuration for the display, the output configuration including values for at least the pixel power supply voltages, the field period and an allowed range of pixel drive levels;

(ii) addressing each pixel by controlling the drive transistor to drive a substantially constant current through the display element for a duration which depends on the desired display pixel output level and an optical feedback signal of the optical feedback element; and (iii) monitoring ageing of display elements of the array, varying the output configuration by varying one or more of said values in response to ageing of the display elements, and repeating steps (i) and (ii) for the varied output configuration.

The invention will now be described by way of example with reference to the accompanying drawings, in which.

Figure 1:
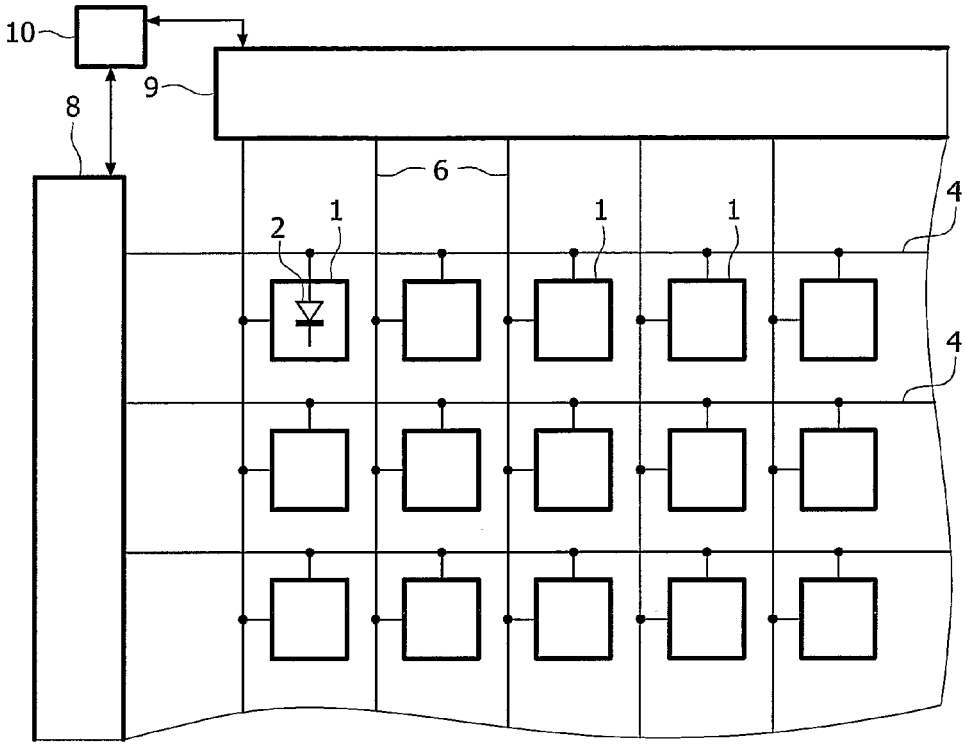
FIG. 1 PRIOR ART
FIG. 1 shows a known EL display device.
Figure 2:
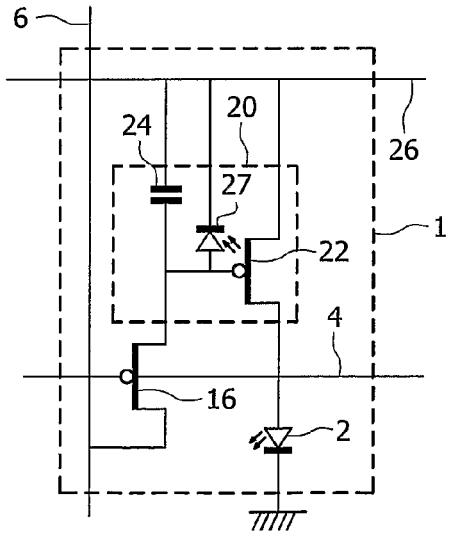
FIG. 2 PRIOR ART
FIG. 2 shows a known pixel design which compensates for differential aging.

It should be noted that these figures are diagrammatic and not drawn to scale. Relative dimensions and proportions of parts of these figures have been shown exaggerated or reduced in size, for the sake of clarity and convenience in the drawings.

A pixel circuit already proposed by the applicant (but not yet published at the time of filing this application) will first be described. In this pixel circuit, the drive transistor is driven with a constant gate voltage during a given frame period, and the period of time during which the display element is illuminated (at a constant brightness) takes into account the aging effect both of the LED material and the drive transistor as well as the desired brightness output.

Figure 3:
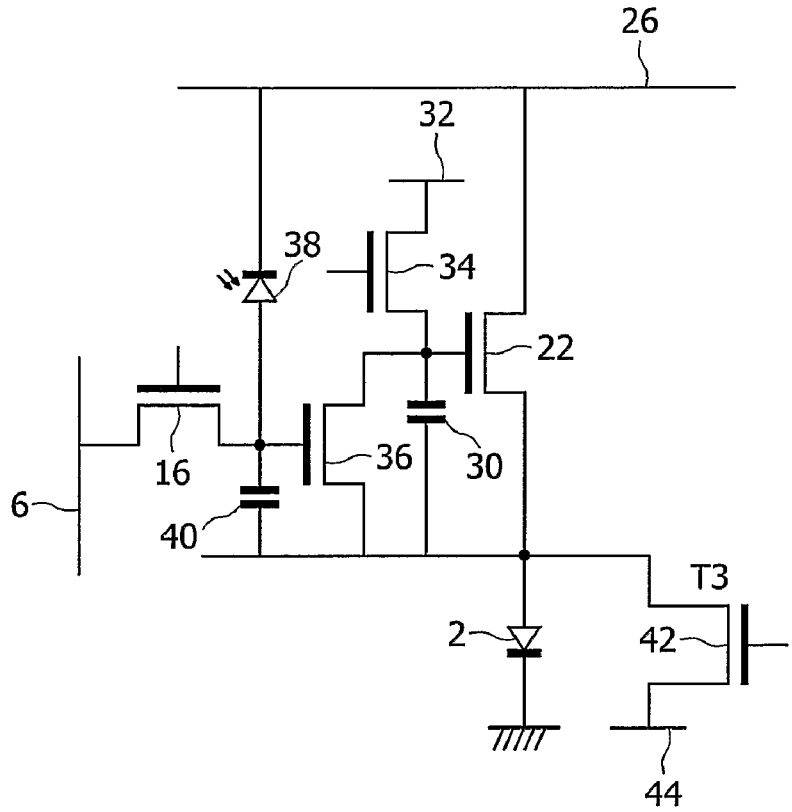
FIG. 3 shows pixel circuit proposed by the applicant.

FIG. 3 shows an example of the proposed pixel layout. The pixel circuit is for use in a display such as shown in FIG. 1. The circuit of FIG. 3 is suitable for implementation using amorphous silicon n-type transistors.

The gate-source voltage for the drive transistor 22 is again held on a storage capacitor 30. However, this capacitor is charged to a fixed voltage from a charging line 32, by means of a charging transistor 34. Thus, the drive transistor 22 is driven to a constant level which is independent of the data input to the pixel when the display element is to be illuminated. The brightness is controlled by varying the duty cycle, in particular by varying the time when the drive transistor is turned off.

The drive transistor 22 is turned off by means of a discharge transistor 36 which discharges the storage capacitor 30. When the discharge transistor 36 is turned on, the capacitor 30 is rapidly discharged and the drive transistor turned off.

The discharge transistor is turned on when the gate voltage reaches a sufficient voltage. A photodiode 38 is illuminated by the display element 2 and generates a photocurrent in dependence on the light output of the display element 2. This photocurrent charges a discharge capacitor 40, and at a certain point in time, the voltage across the capacitor 40 will reach the threshold voltage of the discharge transistor 40 and thereby switch it on. This time will depend on the charge originally stored on the capacitor 40 and on the photocurrent, which in turn depends on the light output of the display element.

Thus, the data signal provided to the pixel on the data line 6 is supplied by the address transistor 16 and is stored on the discharge capacitor 40. A low brightness is represented by a high data signal (so that only a small amount of additional charge is needed for the transistor 36 to switch off) and a high brightness is represented by a low data signal (so that a large amount of additional charge is needed for the transistor 36 to switch off).

This circuit thus has optical feedback for compensating ageing of the display element, and also has threshold compensation of the drive transistor 22, because variations in the drive transistor characteristics will also result in differences in the display element output, which are again compensated by the optical feedback. For the transistor 36, the gate voltage over threshold is kept very small, so that the threshold voltage variation is much less significant.

As shown in FIG. 3, each pixel also has a bypass transistor 42 (T3) connected between the source of the drive transistor 22 and a bypass line 44. This bypass line 44 can be common to all pixels. This is used to ensure a constant voltage at the source of the drive transistor when the storage capacitor 30 is being charged. Thus, it removes the dependency of the source voltage on the voltage drop across of the display element, which is a function of the current flowing. Thus, a fixed gate-source voltage is stored on the capacitor 30, and the display element is turned off when a data voltage is being stored in the pixel.

Figure 4:
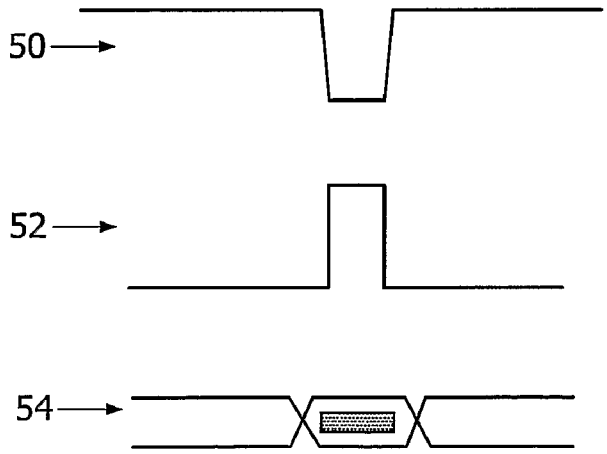
FIG. 4 is a timing diagram for explaining the operation of the circuit of FIG. 3.

FIG. 4 shows timing diagrams for the operation of the circuit of FIG. 3 and is used to explain the circuit operation in further detail.

The power supply line has a switched voltage applied to it. Plot 50 shows this voltage. During the writing of data to the pixel, the power supply line 26 is switched low, so that the drive transistor 22 is turned off. This enables the bypass transistor 42 to provide a good ground reference.

The control lines for the three transistors 16,34,42 are connected together, and the three transistors are all turned on when the power supply line is low. This shared control line signal is shown as plot 52.

Turning on transistor 16 has the effect of charging the discharge capacitor 40 to the data voltage. Turning on transistor 34 has the effect of charging the storage capacitor 30 to the constant charging voltage from charging line 32, and turning on transistor 42 has the effect of bypassing the display element 2 and fixing the source voltage of the drive transistor 22. As shown in plot 54, data (the hatched area) is applied to the pixel during this time.

The circuit above is an n-type only arrangement, which is therefore suitable for amorphous silicon implementation.

Figure 5:
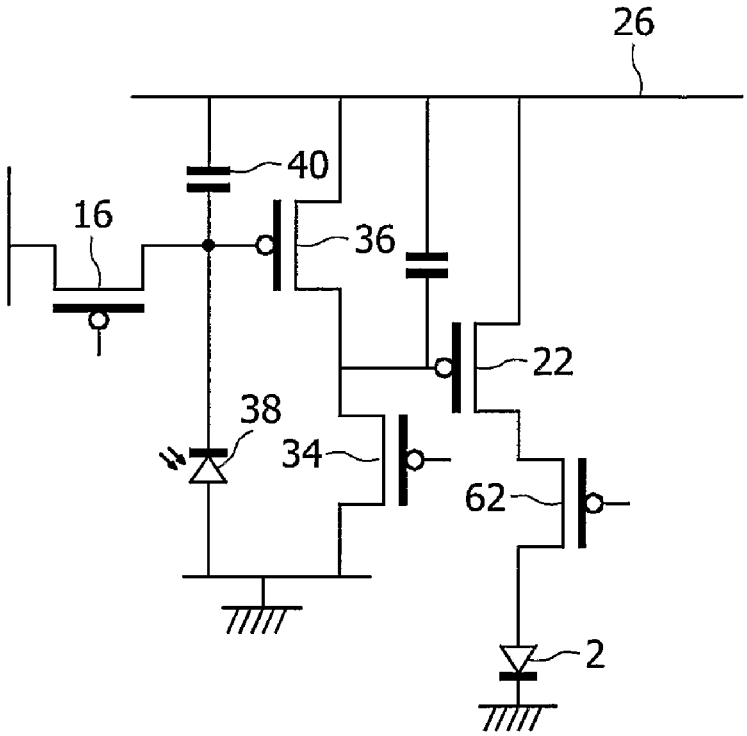
FIG. 5 shows a modification to the circuit of FIG. 3.

FIG. 5 shows a n-type and p-type circuit, suitable for implementation using a low temperature polysilicon process, and which uses n-type and p-type devices.

The drive transistor 22 is implemented as a p-type device. The storage capacitor 30 is connected between the power supply line 26 and the gate of the drive transistor 22, as the source is now connected to the power supply line. Similarly, the discharge transistor 36 is a p-type device, and the discharge capacitor 40 is thus connected between the power supply line 26 and the gate of the transistor 36. In this circuit, charge is removed from the capacitor 40 by the photodiode 38 to result in a drop in the gate voltage of the discharge transistor 36 until it turns on.

The charging transistor 34 is also a p-type device and is connected between the gate of the drive transistor 22 and ground. The charging operation effected by the transistor 34 is thus to charge the capacitor until the full power supply voltage is across it. This holds the gate of the drive transistor 22 at ground, which turns the drive transistor fully on (as it is a p-type device).

Fundamentally, therefore, the circuit operates in the same way as the circuit above, with adaptations to allow the use of p-type transistors.

An isolating transistor 62 enables the display element 2 to be turned off during the addressing phase so that black performance is preserved. In FIG. 5, this is a p-type device, although it may of course be an n-type device.

Figure 6:
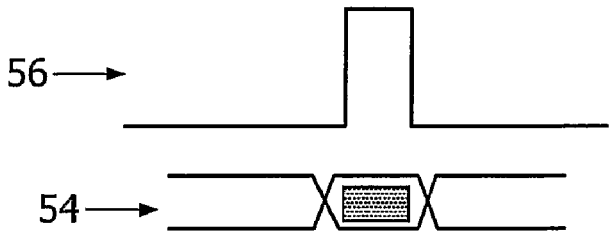
FIG. 6 is a timing diagram for explaining the operation of the circuit of FIG. 5.

As shown in FIG. 6, the gate control signal 56 turns the p-type transistor 62 on when it is low, and when it goes high for the addressing period, the transistor 62 is turned off while the transistors 16,34 are turned on (by a signal which is the inverse of 56).

The total lifetime of OLED displays remains the most critical factor for displays of this type, especially for the blue LED pixels. Any measure that enables extended lifetime is therefore important.

This invention relates to the control of the pixel circuit of the type described above over its lifetime, in order to obtain extended lifetime, whilst maintaining the benefit of compensated differential ageing. The main factors effecting the display lifetime are the power supply voltages, the frame time and the data voltage range. This invention relates to the control of these parameters to obtain the best possible display lifetime with minimal differential ageing.

The invention extends the life of a display using the optical feedback compensation system, but determining when the optical feedback system has reached the limit of its correction capability, and then varying an output configuration for the display. This output configuration includes values for the pixel power supply voltages, the field period and an allowed range of pixel drive levels. By varying one or more of these parameters, the correction capability is extended.

Figure 7:
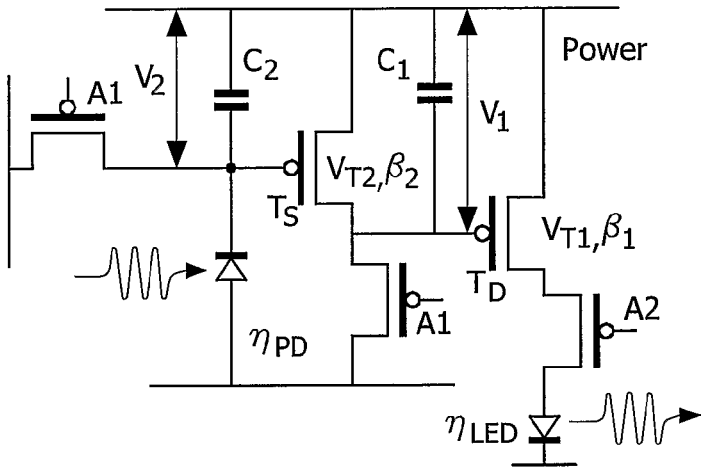
FIG. 7 shows the device characteristics for the circuit of FIG. 6 for the purposes of explaining in more detail the operation of the circuit of FIG. 6.

In order to explain the method and circuit modifications of the invention, it is useful to analyse the operation of the circuit described above in more detail. For this purpose, FIG. 7 shows the circuit of FIG. 6, with the component values indicated for the purpose of analysis. The subscript 1 relates to the drive transistor 22 (and which will be termed $T_D$) and the subscript 2 relates to the discharge transistor 36 (and which will be termed $T_S$).

The current supplied to the OLED by $T_D$ can be written as $I_1=f(V_1, V_{DS})$ and the luminance of the OLED is $L=\eta_{LED}I_1/A_{LED}$ where $\eta_{LED}$ is the efficiency of the OLED in Cd/A and $A_{LED}$ is the area of the pixel aperture. It can assumed that $T_S$ is a perfect switch so that $I_1=H(V_2-V_{T2})$ where H is a step function that is zero until $V_2$ equals $V_{T2}$. The differential equations that describe the circuit operation are given in equation [2].

$$C_1\frac{dV}{dt} = -H(V_2(t) - V_{T2}) \qquad [2]$$

$$C_2\frac{dV_2}{dt} = \eta_{PD}\eta_{LED}f(V_1(t), V_{DS}(t))\frac{A_{PD}}{A_{LED}}$$

Figure 8:
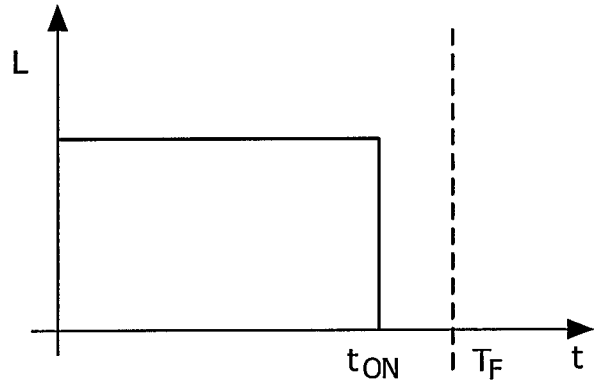
FIG. 8 shows the pixel output for one field.

The first of the pair of equations comes from the discharge of capacitance $C_1$ and the second from the charging of $C_2$ by the photodiode whose efficiency is $\eta_{PD}$ with units of A/Cd and has area $A_{PD}$. As H is a step function, we can easily solve these coupled equations. The solution for $V_1$ is simply:

$$V_1(t) = \begin{cases} V_1(0) & \text{for } t \le t_{ON} \\ 0 & \text{for } t > t_{ON} \end{cases}$$

where $t_{ON}$ is the time for which the circuit emits light as shown in FIG. 8.

As $V_1(t)$ is fixed until $t_{ON}$ is reached $V_{DS}(t)$ can also be found.

$$V_{DS}(t) = \begin{cases} V_P - V_{LED}(0) & \text{for } t \le t_{ON} \\ V_P - V_{TLED} & \text{for } t > t_{ON} \end{cases}$$

where $V_P$ is the power supply voltage, $V_{LED}$ is the OLED anode voltage, and $V_{TLED}$ is the threshold voltage of the OLED. This can easily be solved for $V_2$.

$$V_2(t) - V_2(0) = \begin{cases} \frac{\eta_{PD}\eta_{LED}}{C_2}\frac{A_{PD}}{A_{LED}}f(V_1(0), V_P - V_{LED}(0))t & \text{for } t \le t_{ON} \\ \frac{\eta_{PD}\eta_{LED}}{C_2}\frac{A_{PD}}{A_{LED}}f(0, V_P - V_{LED})t & \text{for } t > t_{ON} \end{cases}$$

$t_{ON}$ can then be found because this will be the time at which $T_S$ switches on i.e. when $V_2(t)=V_{T2}$. The average luminance of the circuit is given by:

$$L_{AV} = \frac{\eta_{LED}}{A_{LED}}f(V_1(0), V_P - V_{LED}(0))\frac{t_{ON}}{T_F}$$

where $T_F$ is the frame time. Therefore, when $t_{ON}<T_F$ $$L_{AV} = \frac{C_2}{A_{PD}\eta_{PD}T_F}(V_{T2} - V_2(0)) \qquad [3]$$

This shows that the circuit is independent of the OLED efficiency and the parameters of the drive TFT $T_D$ when it is assumed that $T_S$ is a perfect switch. The parameters that can be used to control brightness are the voltage $V_2(0)$ and the frame time $T_F$.

Figure 9:
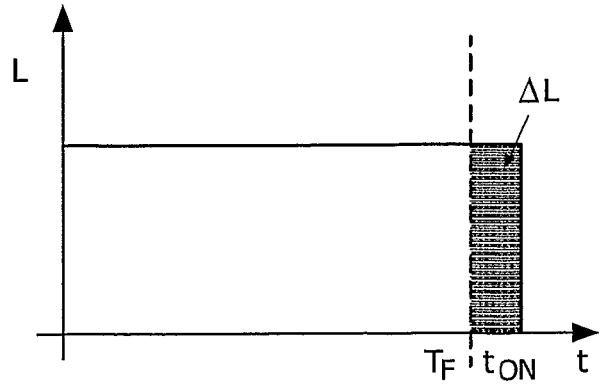
FIG. 9 shows how the pixel output can not be corrected after more serious ageing effects.

If, however, $t_{ON}>T_F$ then errors occur in the differential aging correction capability of the circuit. In this case the luminance error will be:

$$\Delta L = \frac{C_2}{A_{PD}\eta_{PD}T_F}(V_{T2} - V_2(0)) - \frac{\eta_{LED}}{A - LED}f(V_1(0), V_P - V_{LED}(0))$$

which is positive i.e. the circuit has provided too much luminance because the end of the frame time has been reached, as shown in FIG. 9.

This error needs to be less than or equal to zero i.e. $\Delta L \leqq 0$, which gives:

$$\frac{C_2}{A_{PD}\eta_{PD}T_F}(V_{T2} - V_2(0)) \le \frac{\eta_{LED}}{A_{LED}}f(V_1(0), V_P - V_{LED}(0)) \qquad [4]$$

An assumption can be made about the drive TFT $T_D$. As the lowest power consumption of the circuit can be achieved when $T_D$ is driven in its linear region it can be assumed that:

$$I_1 = f(V_1(0), V_P - V_{LED}(0)) = \beta(V_1(0) - V_{T1})(V_P - V_{LED}(0))$$

where β is the trans-conductance parameter of $T_D$. Assuming a simple model for the OLED i.e.

$$I_1 = \frac{\alpha}{2}(V_{LED}(0) - V_{TLED})^2$$

then $$V_P - V_{LED}(0) = \frac{\alpha(V_{LED}(0) - V_{TLED})^2}{2\beta(V_1 - V_{T1})}$$

substituting into equation [4]:

$$V_{LED}(0) \ge V_{TLED} + \sqrt{(V_{T2} - V_2(0))\frac{2C_2}{\eta_{LED}\eta_{PD}\alpha T_F}\frac{A_{LED}}{A_{PD}}} \qquad [5]$$

or $$V_{LED}(0) \ge V_{TLED} + (V_{T2} - V_2(0))\sqrt{\frac{\tau}{T_F}}$$

where τ is a time constant given by $$\tau = \frac{2C_2}{\eta_{LED}\eta_{PD}\alpha(V_{T2} - V_2(0))}\frac{A_{LED}}{A_{PD}}$$

As the OLED ages, both $\eta_{LED}$ and a will reduce which will increase τ and hence the initial OLED voltage necessary to give sufficient luminance within a frame time and to make sure the circuit turns off within the frame time. As $T_D$ is in its linear region then the power supply will be slightly above the OLED voltage. Therefore either the power supply or frame time will need to be increased or data voltage range decreased as the OLED degrades.

Figure 10:
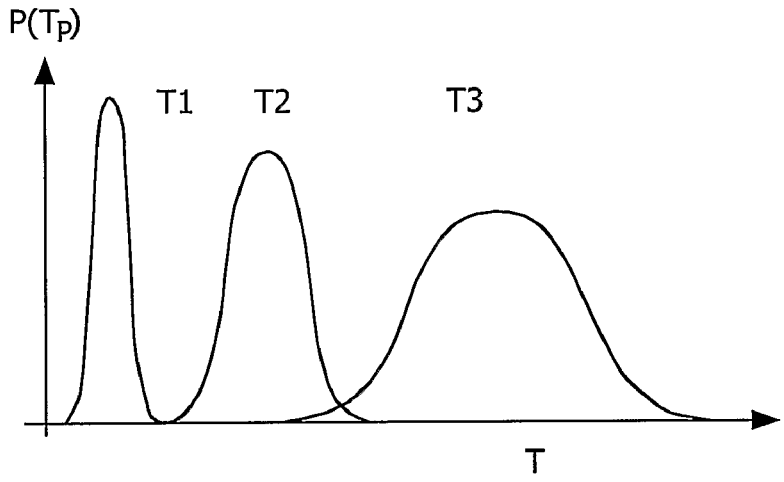
FIG. 10 shows how a pixel output capability varies over time.

The pixel usage for an AMPLED display is shown in FIG. 10. This shows the probability of pixel usage over lifetime $P(T_P)=T_P/T_{max}$ versus time T. $T_P$ is a total pixel on-time and $T_{max}$ is the maximum possible time for a pixel to be on. The three plots show the probability of any pixel having a given on-time, and each plot represents the pixels for a display of different age.

The spread in pixel usage (i.e. pixel on-time) at the beginning of the display lifetime (T1) is quite small and therefore the visible effects of burn-in will be negligible. Over the lifetime of the display (T2 then T3) the distribution will become broader and burn-in effects will become more serious.

This shows that the effects of burn-in (i.e. differential ageing of the LED display elements) will not be significant at the beginning of the display lifetime, so that the optical feedback compensation scheme will not require the full frame period to perform differential ageing compensation.

As a result, at the beginning of life the display, the display can be operated at low power supply ($V_P$) and burn-in will not have occurred. This will reduce heating and therefore reduce the degradation of the OLED. As the display ages, the spread in pixel usage will become more serious and the correction measures of optical feedback will need to come into play. This will require:

(A) increasing the power supply (so that enough light output can be provided within the field period); and/or (B) increasing the frame time (so that more time is available to provide compensated integrated light output for all pixels), and/or (C) reducing the data voltage range (so that no pixels are driven to the maximum brightness output).

Measure (A) will enable a constant luminance over lifetime at the expense of greater heating and hence shorter life. Measures (B) and (C) will reduce the luminance over lifetime but without burn-in. For example, by increasing the frame time, the frames rate will be reduced, which of course will reduce the average light output, and this may also induce flicker.

The invention involves manipulating the power supply voltages, and/or the frame times and/or the data voltage range over the lifetime of the display, to enable the differential ageing compensation to be effective over a prolonged lifetime of the display.

In a preferred implementation, the power supply lines are arranged to run vertically, with a separate power supply for Red, Green and Blue display elements. Each power supply can be adjusted to suit the voltage operation of each colour and therefore lower the overall power consumption and improve lifetimes.

In order implement control of the display operating characteristics, the distribution of pixel usage in the display needs to be determined. For a display with vertical power lines, this can be achieved by sensing the state of the voltage on the storage capacitor for the drive transistor gate voltage, $C_1$ in FIG. 7.

If $C_1$ is fully charged at the end of the field period, then there has not been sufficient luminance to turn the pixel off. In this case, the invention recognises the need to either increase the power supply voltage, increase the frame time or decrease the data voltage range for this pixel.

The invention involves sensing the state of all pixels, and then making a judgment on whether any of the three measures above needs implementing.

Figure 11:
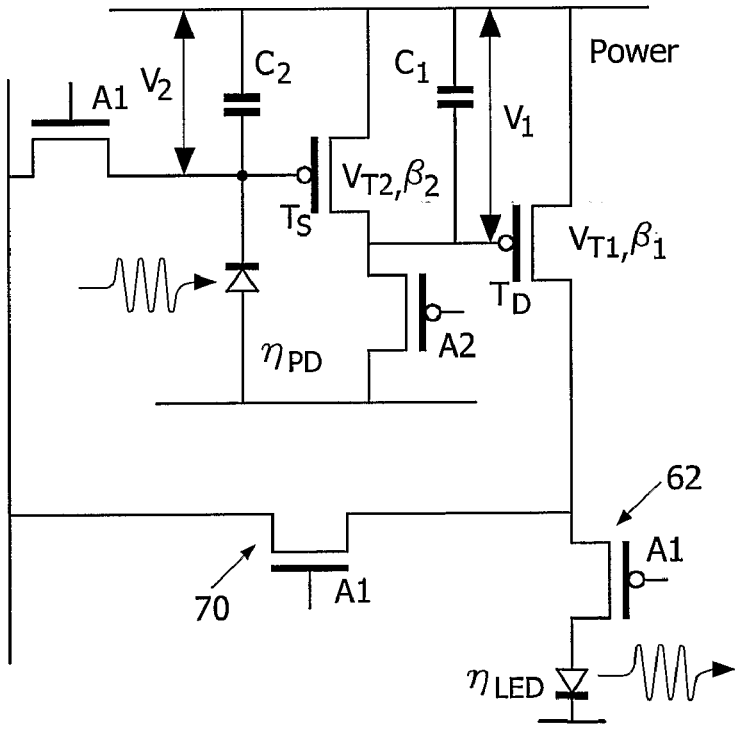
FIG. 11 shows a modified pixel circuit of the invention.

FIG. 11 shows a modification to the pixel circuit of FIG. 7 to allow the conduction state of the drive transistor to be sensed, which in turn provides an indication of the voltage on $C_1$. The pixel circuit includes an extra transistor 70, which is gated by the same control line as the isolating transistor 62 but operates in complementary manner. This circuit enables the state of the voltage on $C_1$ to be sensed from the column and requires one extra TFT but no further columns or address lines.

The transistor 70 is in series with the drive transistor, and if the drive transistor is turned on, there is a connection to the power line through the drive transistor, which can be detected.

The transistor 70 is only turned on when the particular row of pixels is being addressed. Thus, within any column, only one pixel has the transistor 70 turned on at any time, and the state of $C_1$ can be determined for individual pixels.

Figure 12:
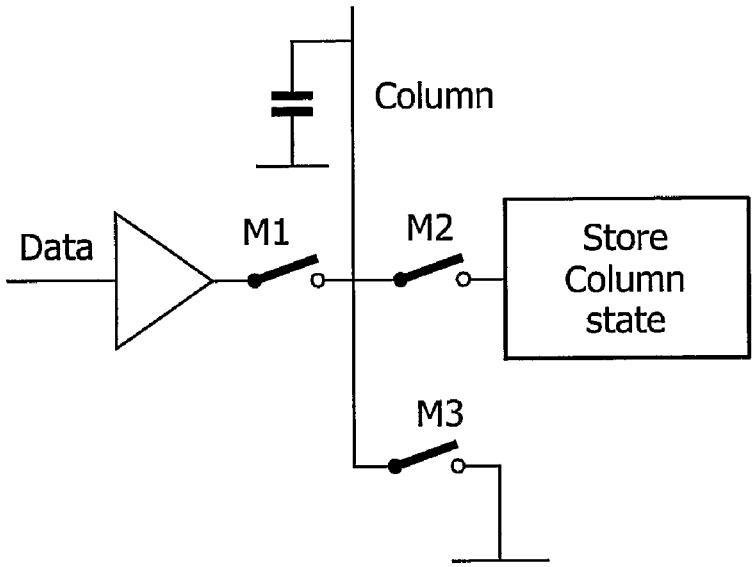
FIG. 12 shows a first example of modified column circuitry for implementing the invention.
Figure 13:
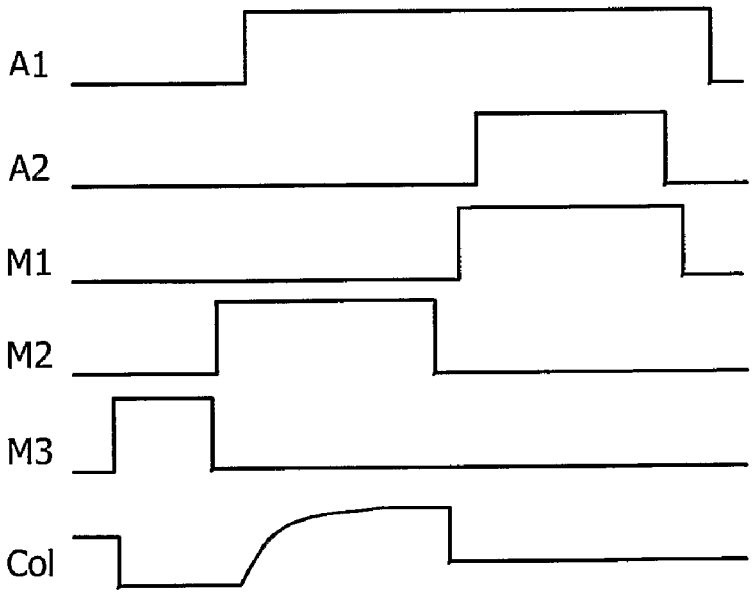
FIG. 13 is a timing diagram for explaining the operation of the circuit of FIG. 12.

FIG. 12 shows the sensing circuit within the column driver and FIG. 13 shows the timing of the pixel address lines and the column driver switches M1, M2 and M3 of FIG. 12, where high is closed.

Just before a pixel is addressed (i.e. at the end of the previous field period), the column is pre-charged with a low voltage by closing switch M3.

M3 is then opened and M2 is closed to measure the state of the column voltage. If $C_1$ is not discharged, then the column will become charged to a high voltage as the drive TFT is on, whereas if $C_1$ is discharged then the column will remain at the low voltage as the drive TFT is off. Thus, a charging of the column voltage is indicative of an on drive transistor, which in turn is indicative that the optical feedback system has not been able to provide full correction.

The state of the column is then stored in memory. M2 is then opened and M1 closed so that the column is then charged to the next data voltage. The normal addressing phase then follows, and the invention is implemented as an additional step in the addressing cycle, having a duration corresponding to the duration of the control pulse for M2. This duration must simply be sufficient for the charging of the column capacitance by the power supply line through the on drive transistor, and may be of the order of a few microseconds.

At the end of the field time all pixels will have been sensed and a number of schemes can be used to control the display parameters in response to the collected date.

In one scheme, if any pixel has a storage capacitor $C_1$ which was not discharged at the end of the field time, the corrective measures are taken. As outlined above, these corrective measures can be:

(i) Increase the power supply line voltage by $\Delta V$ after each field until no columns are sensed high, and/or (ii) Increase frame time by $\Delta T$ after each field until no columns are sensed high and/or (iii) Decrease the data voltage range by $\Delta V_D$ after each field until no columns are sensed high.

In an alternative control scheme, the correction measures can only be employed if greater than a predetermined number N of pixels have a capacitor $C_1$ that is not discharged at the end of the field time.

The correction scheme based on individual pixels enables no burn-in to be tolerated, but this may not be desirable, as there may be a pixel fault. The correction scheme which allows a level of burn-in specified by the predetermined number N is therefore preferred.

Figure 14:
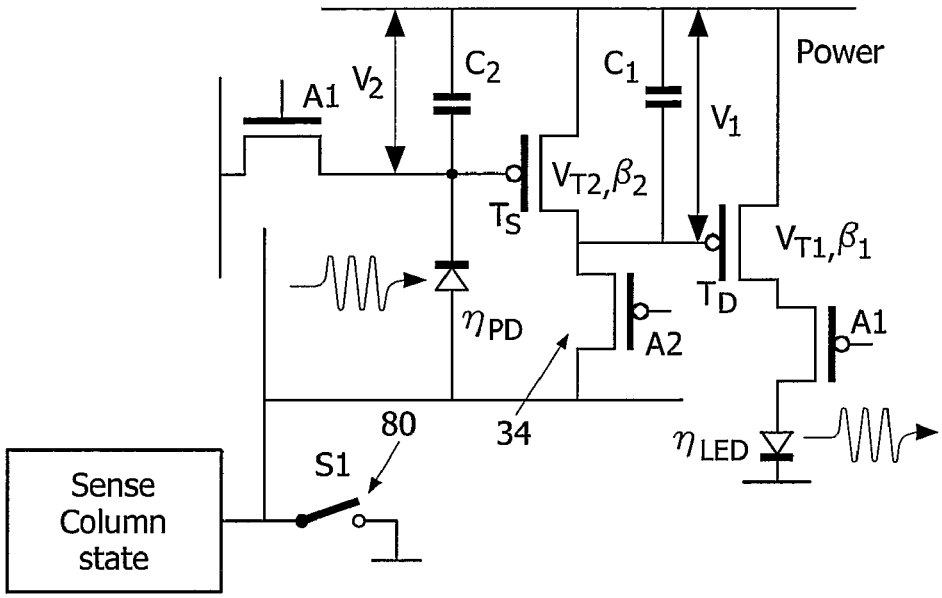
FIG. 14 shows a second example of modified column circuitry for implementing the invention.

FIG. 14 shows another method for achieving pixel state sensing, and which requires an additional transistor 80 per column. The low potential line for the pixels is arranged to runs parallel to the columns, and the additional transistor 80 selectively couples the low potential line to the low potential voltage source (ground).

In this arrangement, the low potential line can be pre-charged low. During the sensing operation, the line is isolated from the low voltage source by the transistor, and the voltage on the line is then monitored. In this arrangement, the discharge transistor $T_S$ is used to charge the low potential column line high if the storage capacitor $C_1$ has been discharged. If the capacitor $C_1$ has been discharged, this is because the optical feedback system has turned on the discharge transistor. As a result, there is a conduction path from the power supply line, through the discharge transistor and the charging transistor 34 (which is on during the field period).

In this case, the discharge transistor $T_S$ will be at its threshold voltage so the charging time will be quite long. Therefore this method is best implemented when sufficient time is available, for example each time the display turned off.

Figure 15:
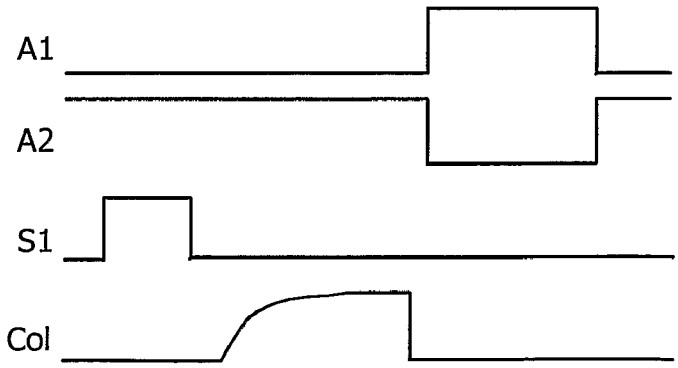
FIG. 15 is a timing diagram for explaining the operation of the circuit of FIG. 14.

The timing diagram for sensing is shown in FIG. 15 for the case when the column charges to a high voltage, which occurs when $C_1$ has been discharged. FIG. 15 shows the case where the pixel is addressed immediately after sensing. This arrangement again enables the state of each pixel discharge transistor to be determined during a full addressing cycle of the display.

The storage of the column state in the circuits above can be performed in analogue or digital modes.

Figure 16:
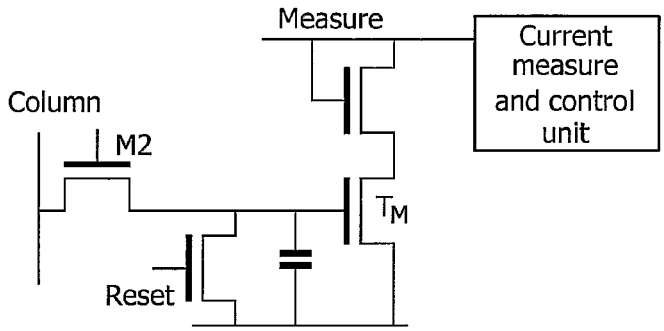
FIG. 16 shows a third example of modified column circuitry for implementing the invention.

FIG. 16 shows an analogue implementation. If the column is charged high when M2 is closed (referring to FIG. 12) then current will flow through transistor $T_M$. Any other column that goes high will also draw current via a $T_M$ for that column so the current on the measure line (if shared between all columns) will be the total of all columns going high and this will be measured. This represents an analysis for the combination of pixels within a row. A value corresponding to this current can be stored and accumulated with the currents generated for all other rows in the display. The resultant value can then be used to adjust the power supplies, frame time etc.

A digital method can use a latch at the output of the column driver shift register to store and clock out the value sensed upon the column. The values are then accumulated and fed to decision logic that will adjust the appropriate parameters.

In the examples above, the sensing function is described as occurring just before the line is re-addressed. This can be extended to any time in the frame period. For example, it may be desirable to limit the duty cycle of the LED display element so that it does not exceed 50%. By illuminating the display element with higher brightness but with a shorter duty cycle, the lifetime of the display can be further extended. In this case, the sensing function can take place half way through the field period, during the part of the field period when there is no light output.

If each addressing phase includes a period for sensing then any line (for example row conductor) can be used for sensing while a different line is used for addressing. The line addressed and the line sensed can be controlled by a row driver with two outputs as shown in FIG. 17.

Figure 17:
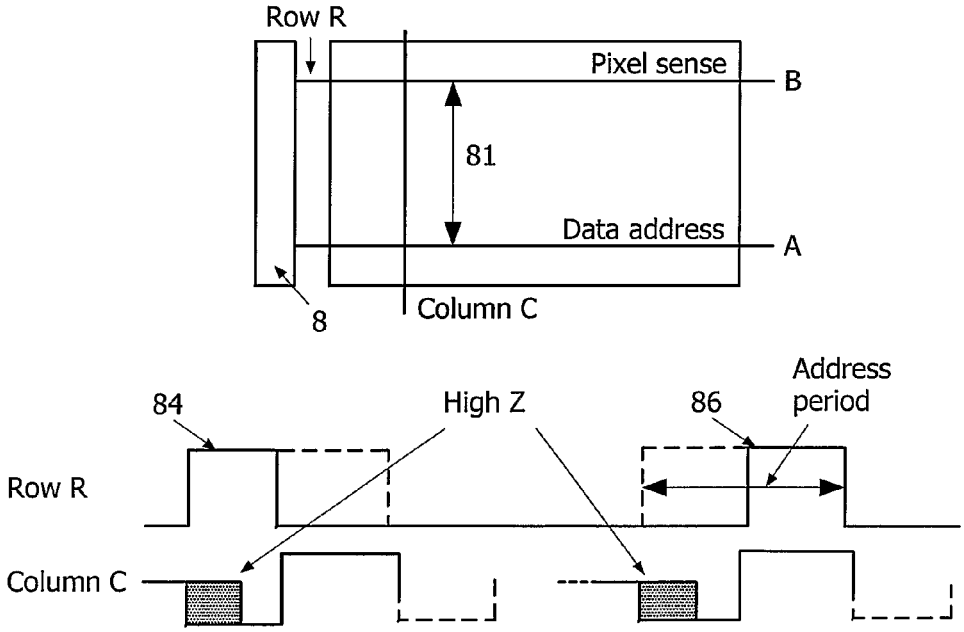
FIG. 17 is used to explain an alternative circuit operation of the invention.

FIG. 17 shows a row driver 8 with two outputs A,B. At any time, one output A is used for addressing a row of pixels, and the other output B is used for the sensing function. The two outputs are staggered by a fraction 81 of the field period so that the sensing operation takes place after illumination of the pixels in the row is complete.

As shown in the timing diagram, the address period 82 for each row comprises two portions. One portion 84 (the first portion) is used for the sensing function and the other portion 86 is used for the addressing function During the sensing operation, the column conductor is initially high impedance ("High Z"), but then it is driven low to ensure the pixel is off. During the pixel addressing operation, the row pulse 86 corresponds as usual to the timing of the data signal on the column conductor. For each field period, each column is thus used twice, once for sensing and once for addressing.

The preferred implementations described above use vertical power lines. However, horizontal power lines may also be used. In this case, the current flowing on the horizontal power line can be sensed at the appropriate time and adjustments made in the same way as described above.

The above description relates to the implementation of the invention to one specific optical feedback pixel design. There are various possible alternative implementations of the optical feedback system to which the invention can be applied.

Figure 18:
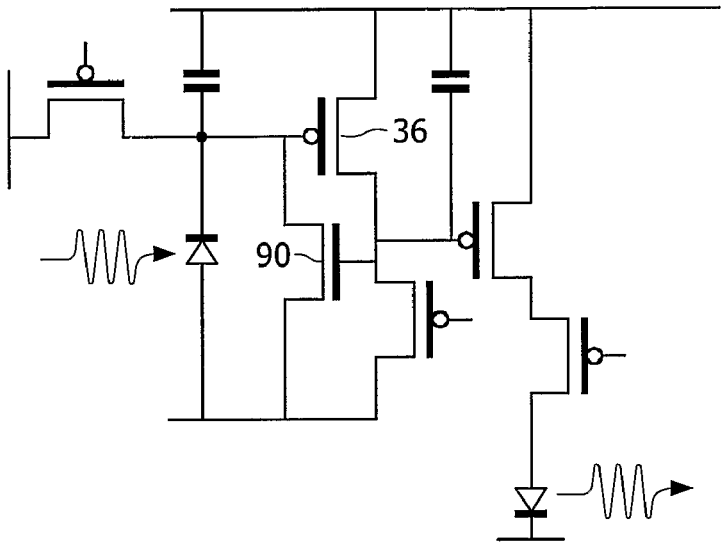
FIG. 18 shows a further example of pixel circuit which can be modified by the invention.

FIG. 18 shows a modification to the pixel circuit of FIG. 7, in which an additional transistor 90 is provided between the gate of the discharge transistor 36 and the ground line and acts to increase the rate of discharge when the optical feedback system operates to switch off the display element.

The circuit shown in FIG. 18 can also be used for sensing as the TFT 90 will enable the column to be driven low if the circuit has switched off.

The examples of the invention above use polysilicon drive $TFT_S$, although an example of amorphous silicon optical feedback circuit is shown in FIG. 3. One variation to FIG. 3 is to couple the photodiode to the charging line 32, so that the power line 26 is connected only to the drive transistor 22. This enables the power supply line 26 to be switched, so that the display element can be turned off during the addressing phase. This improves the darkness of a pixel drive to black. Furthermore, this enables the bypass transistor to be omitted. An implementation of the invention to this type of circuit is shown in FIG. 19.

Figure 19:
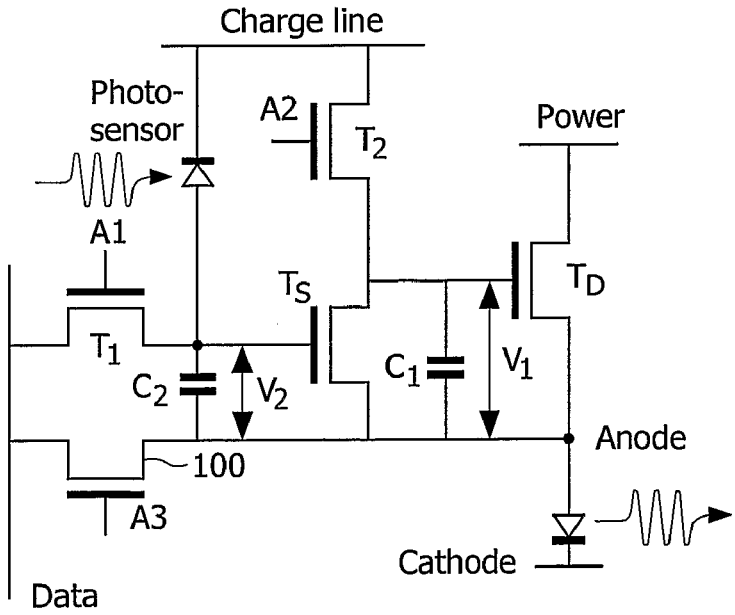
FIG. 19 shows how an amorphous silicon circuit, similar to that shown in FIG. 3, can be modified in accordance with the invention.

FIG. 19 corresponds essentially to FIG. 3, with the modifications outlined above, and in which an additional transistor switch 100 is connected between the anode of the display element and the column line, to enable the sensing operation to be carried out.

In the examples above, the control parameters include the power supply voltage. This may be the voltage provided to the power supply line 26, but the control of the display can also be achieved by modifying the voltage on the charge line 32. This charge line voltage is one of the pixel power supply voltages. Thus, the pixel power supply voltages include the charging line 32 voltage (where this is separate to the main power supply line) and the power supply line 26 voltage.

The examples above are common-cathode implementations, in which the anode side of the LED display element is patterned and the cathode side of all LED elements share a common unpatterned electrode. This is the current preferred implementation as a result of the materials and processes used in the manufacture of the LED display element arrays. However, patterned cathode designs are being implemented, and this can simplify the pixel circuit.

In the example above, optical feedback is used for compensation of the ageing of the LED material and the drive transistor. If the variations in the threshold voltage are very large, which may be the case for amorphous silicon drive transistors, some electrical threshold voltage compensation may be required. This can be achieved by holding the gate-source voltage for the drive transistor on two capacitors in series, a storage capacitor and a threshold capacitor. The discharge capacitor for turning off the discharge transistor is arranged to short out the storage capacitor. The circuit can then provide the (fixed) drive voltage level on the storage capacitor 30 and store the drive transistor threshold voltage on the threshold capacitor There are numerous other variations and refinements to the optical feedback system described above.

In the examples above, the light dependent element is a photodiode, but pixel circuits may be devised using phototransistors or photoresistors. Circuits have been shown using a variety of transistor semiconductor technologies. A number of variations are possible, for example crystalline silicon, hydrogenated amorphous silicon, polysilicon and even semiconducting polymers. These are all intended to be within the scope of the invention as claimed. The display devices may be polymer LED devices, organic LED devices, phosphor containing materials and other light emitting structures.

The adjustment to the display configuration can be to change the configuration for all pixels. This will be appropriate when the frame time is being varied, for example. However, the adjustment to the display configuration can be for individual groups of pixels, particularly columns of pixels. Thus, different power supply voltages may be applied to different columns. This variation in voltages may require the image data to be processed. In particular, the ageing of the LED display elements may not have a linear effect across all output levels, and a function may need to be applied to the pixel data for the adjusted columns. The voltage changes may instead be made for the full display, in which case pixel data processing may not be required.

One or more of the measures described above for changing the output configuration may be applied, and in any combination.

The control means for varying the display operating characteristics will be of conventional design and will control the voltages and/or timing operations of the row and column address circuits, and such a control means is shown schematically in FIG. 1 as reference 10. For the implementations in which voltage levels are changed, conventional circuitry can be used for adjusting power supply levels, for example the column driver power supply, the display power supply or the pixel charge line power supply level.

The implementation of the sensing operation and the control of the display configuration will be routine to those skilled in the art.

Various other modifications will be apparent to those skilled in the art.

The invention claimed is:

1. An active matrix display device comprising an array of display pixels, each pixel comprising:

a current-driven light emitting display element;

a drive transistor for driving a current through the display element; pixel circuitry including an optical feedback element, for controlling the drive transistor to drive a substantially constant current through the display element for a duration which depends on a desired display pixel output level and an optical feedback signal of the optical feedback element; and control means for varying an output configuration for the display by varying the pixel power supply voltage and at least one of the field period and the allowed range of pixel drive levels in response to monitoring the ageing of the display element, wherein monitoring of the display element comprises monitoring the on or off state of the drive transistors at the beginning or end of a field period, wherein dedicated power supply lines are applied corresponding columns of different colour pixels, each different single dedicated power supply line being adjustable to suit the voltage operation of each colour.

2. A device as claimed in claim 1, wherein the pixel circuitry comprises a storage capacitor for storing a voltage to be used for addressing for the drive transistor.

3. A device as claimed in claim 2, wherein the pixel circuitry comprises a discharge transistor for discharging the storage capacitor thereby to switch off the drive transistor, and wherein the optical feedback element is for controlling the timing of the operation of the discharge transistor by varying the gate voltage applied to the discharge transistor in dependence on the light output of the display element.

4. A device as claimed in claim 3, wherein the optical feedback element (38) controls the timing of the switching of the discharge transistor (36; T2) from an off to an on state.

5. A device as claimed in claim 3, wherein the optical feedback element comprises a discharge photodiode.

6. A device as claimed in claim 3, wherein a discharge capacitor is provided between the gate of the discharge transistor and a constant voltage line, and the optical feedback element is for charging or discharging the discharge capacitor.

7. A device as claimed in claim 1, wherein the drive transistor is connected between a power supply line and the display element.

8. A device as claimed in claim 7, wherein the storage capacitor is connected between the gate and source of the drive transistor.

9. A device as claimed in claim 1, wherein each pixel further comprises a charging transistor connected between a charging line and the gate of the drive transistor.

10. A device as claimed in claim 1, wherein each pixel further comprises an isolating transistor (62) connected in series with the drive transistor (22).

11. A device as claimed in claim 1, wherein power supply lines are provided for each column of pixels.

12. A device as claimed in claim 1, wherein each pixel further comprises a readout transistor (70; 100) to enable detection of the state of the drive transistor (22) from a column conductor.

13. A device as claimed in claim 1, wherein each column of pixels further comprises a readout transistor (80) to enable detection of the state of the drive transistors in the column.

14. A device as claimed in claim 1, wherein the current-driven light emitting display element (2) comprises an electroluminescent display element.

15. A method of driving an active matrix display device comprising an array of display pixels each comprising a drive transistor, a current-driven light emitting display element and pixel circuitry including an optical feedback element, the method comprising:

(i) applying an output configuration for the display, the output configuration including values for at least pixel power supply voltages, a field period and an allowed range of pixel drive levels;

(ii) addressing each pixel by controlling the drive transistor to drive a substantially constant current through the display element for a duration which depends on a desired display pixel output level and an optical feedback signal of the optical feedback element; and (iii) monitoring ageing of display elements of the array, varying the output configuration by varying the pixel power supply voltage and at least one of the field period and the allowed range of pixel drive levels in response to monitoring the ageing of the display element, and repeating steps ii and iii for the varied output configuration wherein dedicated power supply lines are applied corresponding columns of different colour pixels , each different single dedicated power supply line being adjustable to suit the voltage operation of each colour, and wherein monitoring of the display element comprises monitoring the on or off state of the drive transistors at the beginning or end of a field period.

16. A method as claimed in claim 1, wherein if more than a predetermined number of drive transistors are turned on at the end of a field period, then the output configuration is varied.

* * * * *